United States Patent [19]

Colin

[11] Patent Number: 4,631,847

[45] Date of Patent: Dec. 30, 1986

[54] ENCAPSULATED ART

[76] Inventor: Laurence Colin, 142 Garth Rd., Scarsdale, N.Y. 10583

[21] Appl. No.: 211,260

[22] Filed: Dec. 1, 1980

[51] Int. Cl.[4] ..... G09F 19/00

[52] U.S. Cl. ..... 40/407; 434/82; 446/491; 40/485

[58] Field of Search ..... 40/406, 407; 272/8 D

[56] References Cited

U.S. PATENT DOCUMENTS

| | | | |
|---|---|---|---|
| 683,302 | 9/1901 | Lee | 434/81 |
| 2,592,258 | 4/1952 | Economakis | 428/13 |
| 3,387,396 | 6/1968 | Smith | 40/406 |
| 3,464,132 | 9/1969 | Matisse | 40/407 |
| 3,601,923 | 8/1971 | Rosenberg | 46/156 |
| 3,873,485 | 3/1975 | Fichera | 46/156 |
| 3,898,781 | 8/1975 | Fachini | 272/8 D |
| 4,057,921 | 11/1977 | Ball | 40/406 |
| 4,134,853 | 1/1979 | Ehrlich | 46/156 |
| 4,279,674 | 7/1971 | Wadden | 434/84 |

OTHER PUBLICATIONS

Publication "Playthings", dated Feb. 10, 1959, p. 111.

*Primary Examiner*—Gene Mancene
*Assistant Examiner*—Wenceslao J. Contreras
*Attorney, Agent, or Firm*—Alfred E. Miller

[57] ABSTRACT

An artistic display is formed of a first layer of a material between a base and a transparent cover layer. The cover layer and base may be of a flexible plastic material, or they may be of a rigid material, such as glass. The first layer has a putty like consistency, and is formed with different color pigments in different areas of the layer.

18 Claims, 4 Drawing Figures

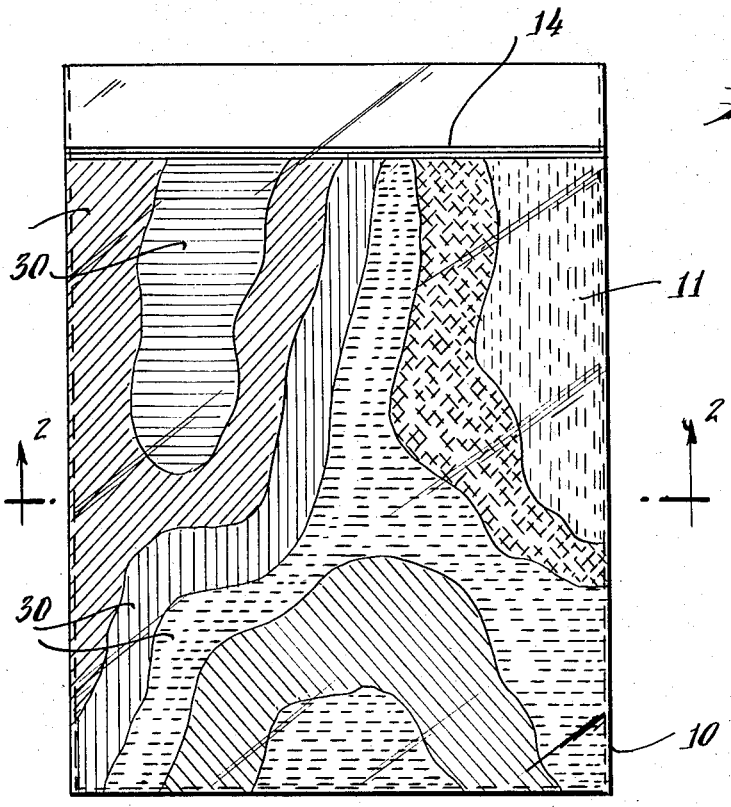
Fig. 1.
Fig. 2.
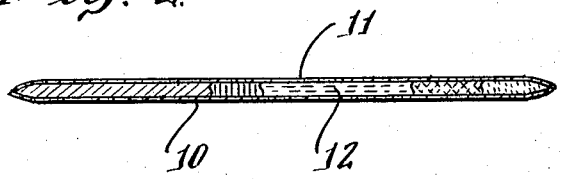
Fig. 3.
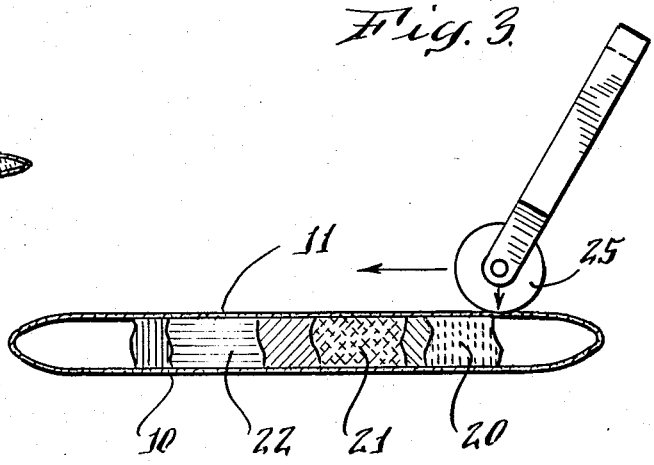
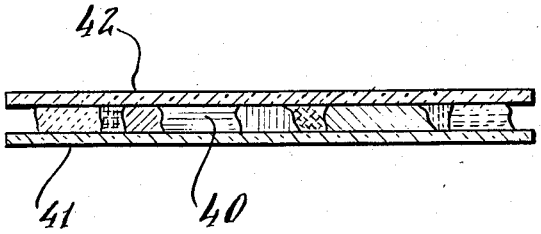
Fig. 4.

ENCAPSULATED ART

This invention relates to artistic devices for display, use or teaching of color patterns, and is more particularly directed to a method and display formed thereby permitting the simple formation of color pattern.

The invention is directed to the provision of a display wherein color patterns may be readily formed and displayed, and wherein the patterns of the display may be readily changed. The invention is also directed to the provision of such a display which can be inexpensively produced, so that, in addition to being useful as an artistic display, it may also readily be employed as a prototype for producing other artistic devices or materials, and is suitable for use as a teaching device of color and art.

Briefly stated, in accordance with the invention, a display device is comprised of a first layer of a given material sandwiched between a base and a transparent cover layer. The base and color layer may be either rigid or flexible materials, and may, for example, be of a plastic material or glass.

The intermediate layer is comprised of a material that is kneadable, i.e., having a putty-like consistency, or being "plastic". This material has, within it, at least two different color pigments to enable the formation of areas of different color in the display. The putty-like consistency of the material is such that, when the material is placed between the base and cover layer, pressure, for example by the hand or by rolling, forces the material to spread, to eventually form a relatively thin layer between the base and the cover layer, to thereby display determined areas with different colors.

In order that the invention will be more clearly understood, will now be disclosed in greater detail with reference to the accompanying drawings, wherein:

FIG. 1 is a front view of an artistic display in accordance with one embodiment of the invention;

FIG. 2 is a cross sectional view of the display of FIG. 1;

FIG. 3 is simplified sketch of a cross section of the display of FIG. 1 during its fabrication; and FIG. 4 is a cross sectional view of a display in accordance with a further embodiment of the invention.

In one embodiment of the artistic display in accordance with the invention, as illustrated in FIGS. 1 and 2, a conventional plastic bag having opposite sides 10 and 11 has a layer 12 of a material of putty-like consistency evenly distributed throughout the bag. The layer may be relatively thin, for example from about 0.5 millimeters to 5.0 millimeters, although a thickness of about 1 millimeter is preferred.

The plastic bag may be of the type having a releasable closure 14 at one end, in order to facilitate filling and the bag, although this feature is not necessary in accordance with the invention. The material of the bag must be non-porous, for example, of Mylar or polyethylene. Of course other similar materials may be employed. The bag of FIGS. 1 and 2 is hence flexible, and at least one of the sides 10 and 11 must be substantially transparent. It is of course conceived that the surface of the bag may have a matte finish, which will be perfectly acceptable in some embodiments of the invention, as long as the colors of the material in the bag may be clearly seen. It is hence intended that the term transparent, as used herein, includes such materials.

The material of the layer 12 is a kneadable material having a putty-like consistency. In other words, the material will not flow as a liquid, but may be manipulated with pressure to change its shape nonelastically, in the manner of putty, dough, clay or the like.

Thus, in embodiments of the invention, the kneadable material may be composed of inert or reactive polysiloxane of various viscosities, mineral fillers of the calcium carbonate or silica type, petrolatum or white mineral oils to serve as release agents and lubricants, and pigments. The pigments preferably form about 0.5 to 2.4% by weight of the material, in order that the colors have sufficient density to permit them to be usable in thin layers of the mixture.

The concept of the invention may perhaps be best illustrated at this point by describing one technique for producing an artistic design in accordance with the invention. First, a number of mixtures of the above type may be prepared, with different colored pigments. Then, these separate batches, such as the batches 20, 21 and 22 are placed in the plastic bag between the sides 10 and 11, as illustrated in FIG. 3. Then the material in the bag is manipulated, for example by rolling a roller 25 thereacross while pressing down on the bag, until the material has been spread to fill the entire bag, as illustrated more clearly in FIG. 1. At this time, the different colored regions will have spread, while maintaining a certain degree of definition therebetween, so that a plurality of differently shaped areas 30 of different colors will be visible through the sides of the bag, as illustrated in FIG. 1. The manipulation of the color regions may of course be effected by hand or other means, and it is apparent that, by the use of selective pressure, the different colored areas may be spread to cover any desired areas.

The resultant design is consequently a flexible flat body having distinctive coloration, in any desired pattern.

In a further modification of the invention, as illustrated in FIG. 4, the layer 40 of kneadable color material is disposed between a pair of sheets 41 and 42 of a rigid material. At least one of the sheets 40 and 41 is transparent, and thus the sheets may be of conventional material such as glass or acrylic. The design in this case is of course rigid, and is formed by pressing the sheets together after the kneadable material has been inserted therebetween.

The putty-like material can be blended and mixed to produce intermediate hues and shades, in a manner similar to that of conventional liquid paints. The materials of the above discussed components are temperature stable and nonsetting. As will be discussed in greater detail in the following paragraphs, however, setting mixtures may also be employed. Since the material is putty-like in consistency, it will not slump or settle as would conventional fluid paints.

While silicone polymer bases have been found to be quite satisfactory for the putty-like material of the invention, materials have also been successfully formulated using an epoxy base, and also using a vegetable oil base. High molecular weight polymers that can be diluted to fluids may also be employed as the basis for the material of the invention.

The following are several examples of the colored putty-like material employed as the color layer, in accordance with the invention.

EXAMPLE A

The following formula is typical of a silicone based putty-like material employed in accordance with the invention;

Inert silicone fluid, 12% by weight.
Lubricant, 6% by weight.
Color pigment, 1 to 2% by weight.
Fillers (carbonate), 80–81% by weight.

The filling rate depends upon the viscosity of the base polymer.

EXAMPLE B

Using an Epon resin, manufactured by Shell Chemical Company, a putty-like material has been formed in accordance with the following example:

Epon resin No. 828, 33% by weight.
Fillers (carbonate), 65% by weight.
Color pigments, 1% by weight.
Lubricants, 1% by weight.

This putty-like material, as in the other examples, may be placed in a plastic envelope, and can be rolled into a thin sheet of the encapsulated design.

EXAMPLE C

It has also been found that satisfactory putty-like materials may employ vegetable oil as a base. Thus, the following example is known to be quite satisfactory:

Vegetable oil, 26% by weight.
Fillers (carbonate), 73% by weight.
Color pigment, 1% by weight.

The materials of all of the above examples are nonvolatile, and hence will maintain their form without shrinkage or dessication. The materials as listed above result in the production of non-setting putties. If a proper catalyst, depending upon the base polymer, is employed, the encapsulated artistic design in accordance with the invention may set within a determined time period. If a silicone system is employed in this case, the resultant design, if it is a flexible plastic material, may be flexible. When an Epon resin is employed, however, the resultant artistic design will be rigid.

As further examples of materials that may be satisfactory for the base, for the present invention, clay or plastocene can be employed if they are first diluted with a proper solvent for such materials.

In a further feature of the invention, the components of the colored putty-like material, as above discussed, have been selected so that the material is essentially nonsticking, i.e., it may be readily separated from the transparent encapsulating layer without destroying the pattern of the design. The above mixtures had been selected in accordance with this feature. As a result, colors may be added to previously formed patterns by opening the plastic bag, or by peeling back the plastic sheet or the like, depending upon the construction of the encapsulation for the design. This feature permits the modification of the design by the application of other premixed colored putty-like material to desired positions in the design. Blending of the added colors may be effected by recovering the colored layer with the plastocene capsulation, and rubbing the pertinent areas of the material to cause the adjacent colors to mix. If blending is not desired, but, instead, complete color integrity of the additional material is required, the additional colored material is placed in the determined position of the uncovered color layer, the transparent plastic cover is again moved to cover the layer, and the layer is rolled, for example, by a roller or tumbler, to maintain the color integrity of the desired pattern.

While, as above discussed, the display in accordance with the invention is useful as an art form, it may also be employed by an artist as a pattern or prototype, to develop a concept before using canvas or other conventional materials. Further, the display of the invention may be employed as an aid in fabric design, the development of wallpaper patterns or any industrial art, in which form and color can be predetermined, by the use of the materials and methods in accordance with the invention. When color coordination is important, the preselection of the required colors can be formed in the above matter to achieve any necessary form, shape or design. In addition, the method and design in accordance with the invention may be employed as a teaching aid, for example, to teach the concepts of color, as well as mixing of colors. It may also be employed in the psychological testing of design, colors and details.

While the invention has been disclosed and described with reference to a limited number of embodiments, it will be apparent that variations and modifications may be made therein, and it is therefore intended in the following claims to cover each such variation and modification as falls within the true spirit and scope of the invention.

What is claimed is:

1. A display comprising a first layer sandwiched between a base and a nonporous transparent second layer, said first layer being of a non-flowable kneadable material of putty-like consistency and having at least two colors in adjoining areas, and visible through said second layer, said kneadable material being spread by applying pressure to said material whereby a plurality of different shaped colored portions are created.

2. The display of claim 1 wherein said second layer and base are of a transparent plastic material.

3. The display of claim 2 wherein said plastic material is Mylar.

4. The display of claim 1 wherein at least one of said base and second layer are transparent glass.

5. The display of claim 1 wherein said first layer is a material comprised of inert silicone fluid, lubricant, color pigment and a filler.

6. The display of claim 5 wherein said material is comprised of about 12% inert silicone fluid, about 6% lubricant, about 1–2% color pigment and about 80–81% of carbonate material as a filler.

7. The display of claim 1 wherein said first layer is a material comprised of a resin, a filler, a color pigment and a lubricant.

8. The display of claim 7 wherein said material is comprised of about 65% of filler, about 1% of a color pigment and about 1% of a lubricant.

9. The display of claim 1 wherein said first layer is a material comprised of vegetable oil, filler and a color pigment.

10. The display of claim 9 wherein said material is comprised of about 26% vegetable oil, about 73% of a filler, and about 1% of a color pigment.

11. The display of claim 1 wherein said first layer has a thickness between 0.5 and 5 millimeters and is comprised of about 0.5 to 2.5 weight percent of a color pigment.

12. The display of claim 11 wherein said base and said first layers are the opposite sides of a plastic bag.

13. The display of claim 12 wherein said material does not adhere to the surfaces of said bag.

14. A method for producing a display comprising separately mixing at least two different color pigments in material of a non-flowable putty-like consistency, placing said two mixtures adjacent one another between a base and a transparent layer, and spreading said two mixtures between said base and transparent layer by pressing said transparent layer and base toward one another.

15. The method of claim 14 comprising mixing said material of a carbonate filler, lubricant and an inert silicone fluid.

16. The method of claim 14 comprising mixing said material of a filler, a lubricant and a resin.

17. The method of claim 14 comprising forming said material of vegetable oil and a filler.

18. The method of claim 14 comprising mixing a catalyst in said material.

* * * * *